US005937947A

United States Patent [19]

Holtby

[11] Patent Number: 5,937,947

[45] Date of Patent: Aug. 17, 1999

[54] METHOD AND APPARATUS FOR PREVENTING ENVIRONMENTAL CONTAMINATION DUE TO FLUID LEAKAGE FROM A WELLHEAD

[75] Inventor: Quinn Holtby, Edmonton, Canada

[73] Assignee: Katch Kan Holdings Ltd., Edmonton, Canada

[21] Appl. No.: 08/773,110

[22] Filed: Dec. 26, 1996

[51] Int. Cl.[6] ..... E21B 33/00; E21B 19/00

[52] U.S. Cl. ..... 166/379; 166/81.1

[58] Field of Search ..... 166/81.1, 379

[56] References Cited

U.S. PATENT DOCUMENTS

| | | | |
|---|---|---|---|
| 560,986 | 5/1896 | Grow | 166/81.1 |
| 1,507,628 | 9/1924 | Schuyler | 166/81.1 |
| 4,949,784 | 8/1990 | Evans | 166/81 |
| 5,121,794 | 6/1992 | Hibdon et al. | 166/81 |
| 5,121,796 | 6/1992 | Wigington, Sr. | 166/379 |
| 5,150,751 | 9/1992 | Burton et al. | 166/81 |
| 5,167,277 | 12/1992 | Evans | 166/81 |
| 5,343,943 | 9/1994 | Norris et al. | 166/81 |
| 5,377,748 | 1/1995 | Gayaut | 166/81 |
| 5,394,939 | 3/1995 | Walker | 166/81 |
| 5,634,485 | 6/1997 | Holtby | 137/15 |

*Primary Examiner*—Thomas B. Will
*Assistant Examiner*—Gary S. Hartmann
*Attorney, Agent, or Firm*—Davis and Bujold

[57] ABSTRACT

A method and apparatus for preventing environmental contamination due to fluid leakage from a wellhead. Firstly, provide an annular ring having a top surface, a bottom surface, an outer edge and a plurality of bolt receiving openings extending between the top surface and the bottom surface. Secondly, provide catch pan having a central opening. Thirdly, secure the central opening of the catch pan to the outer edge of the annular ring. Fourthly, bolt the annular ring to the wellhead by means of bolts extended through the bolt receiving openings.

10 Claims, 3 Drawing Sheets

METHOD AND APPARATUS FOR PREVENTING ENVIRONMENTAL CONTAMINATION DUE TO FLUID LEAKAGE FROM A WELLHEAD

FIELD OF THE INVENTION

The present invention relates to a method and apparatus for preventing environmental contamination due to fluid leakage from a wellhead and, in particular, fluid leakage such as occurs during serving.

BACKGROUND OF THE INVENTION

In the oil industry, wellheads are placed on producing oil wells. The composition of the wellhead may vary but, generally, it consists of a casing head, a tubing head, and an assemblage of controls valves, pressure gauges and chokes collectively referred to as a "Christmas Tree" due to their distinctive appearance. Often a blow out preventer is included as well. The above described components of the wellhead are secured together with a number of flanged connections. When servicing a wellhead, fluids invariably are released and run down the wellhead. This release of fluids contaminates the well site. Some servicing applications include "stripping", in which tubing filled with oil is pulled out of the well through the wellhead, and "swabbing" in which a cup is run down through the wellhead into the well.

SUMMARY OF THE INVENTION

What is required is a method and apparatus for preventing environmental contamination due to release or leakage of fluids from a wellhead during servicing.

According one aspect of the present invention there is provided a method for preventing environmental contamination due to fluid leakage from a wellhead. Firstly, provide an annular ring having a top surface, a bottom surface, an outer edge and a plurality of bolt receiving openings extending between the top surface and the bottom surface. Secondly, provide catch pan having a central opening. Thirdly, secure the central opening of the catch pan to the outer edge of the annular ring. Fourthly, bolt the annular ring to the wellhead by means of bolts extended through the bolting receiving openings.

With the method, as described above, the catch pan is secured to the wellhead. If any release or leakage of fluids does occur during servicing, such leakage is caught by the catch pan.

According to another aspect of the present invention there is provided an apparatus for preventing environmental contamination due to fluid leakage from a wellhead. The apparatus includes an annular ring having a top surface, a bottom surface, an outer edge and a plurality of bolt receiving openings extending between the top surface and the bottom surface. The outer edge is encircled by a flange. A catch pan is provided having a central opening sized to fit snugly over the flange. Means is provided for removably securing in a fluid tight manner the central opening of the catch pan to the peripheral lip.

Although beneficial results may be obtained through the use of the apparatus, as described above, it is preferred that central opening be provided with a depending collar. The means for removably securing in a fluid tight manner the central opening of the catch pan to the flange includes an annular seal encircling the flange. The annular seal engages the depending collar to prevent fluids leaking between the flange and the catch pan.

Although beneficial results may be obtained through the use of the apparatus, as described above, there is a danger of annular seal sliding along the depending collar as the weight of the catch pan increases due to an accumulation of oil. Even more beneficial results may, therefore, be received when stop means project inwardly from the depending collar thereby providing a stop which limits movement of the annular seal.

Although beneficial results may be obtained through the use of the apparatus, as described above, it is important that annular ring be secured to the wellhead in a manner that will not, itself, result in leakage. Even more beneficial results may, therefore, be obtained when a seal groove is positioned on the top surface and the bottom surface of the annular ring. An annular seal may be placed in the seal groove. When the annular ring is bolted in place on the wellhead, the annular seal is compressed and provides protection against leakage. The seal groove ensures the correct positioning of the annular seal.

Although beneficial effects may be obtained through the use of the apparatus, as described above, the catch pan has a limited capacity. Even more beneficial results may, therefore, be obtained when the catch pan has a drainage opening, a drain conduit extending from the drainage opening in the catch pan to a storage container.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
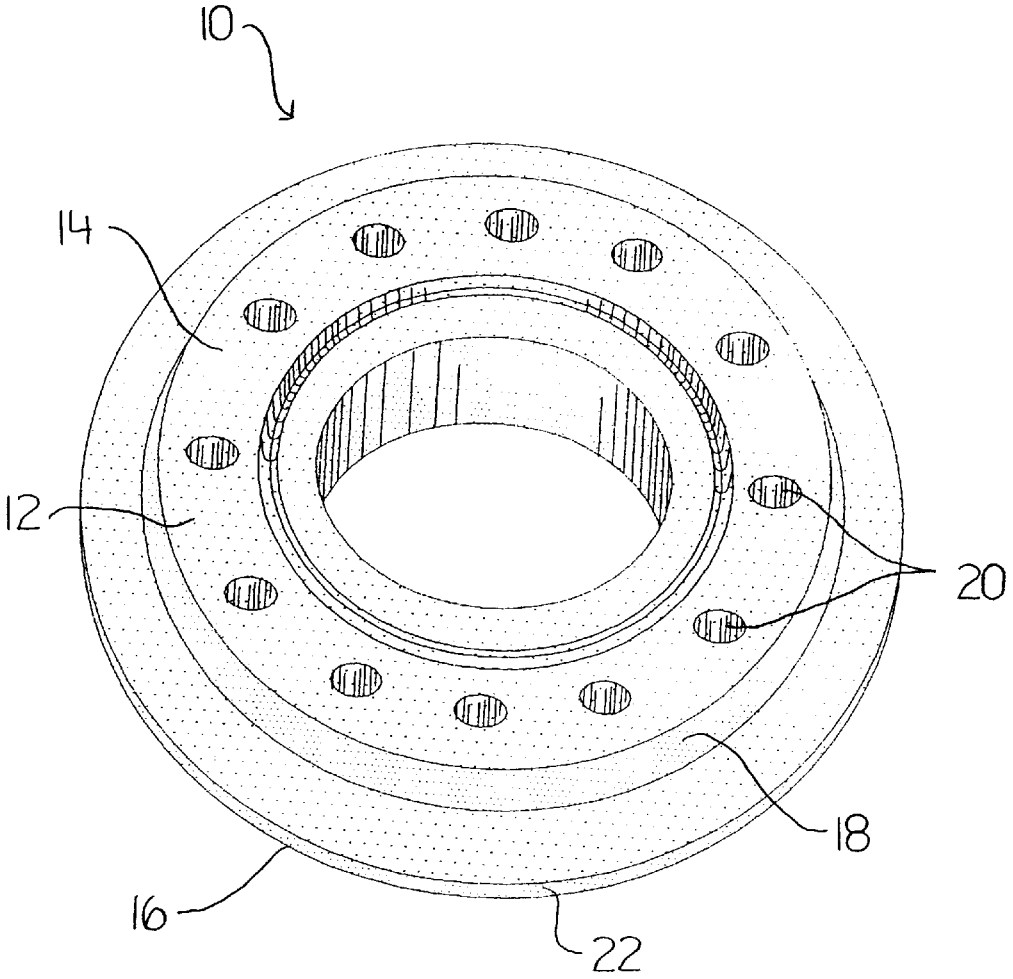
FIG. 1 is a perspective view of an annular ring from an apparatus for preventing environmental contamination due to fluid leakage from a wellhead.

The preferred embodiment, an apparatus for preventing environmental contamination due to fluid leakage from a wellhead generally identified by reference numeral 10, will now be described with reference to FIGS. 1 through 5.

Figure 2:
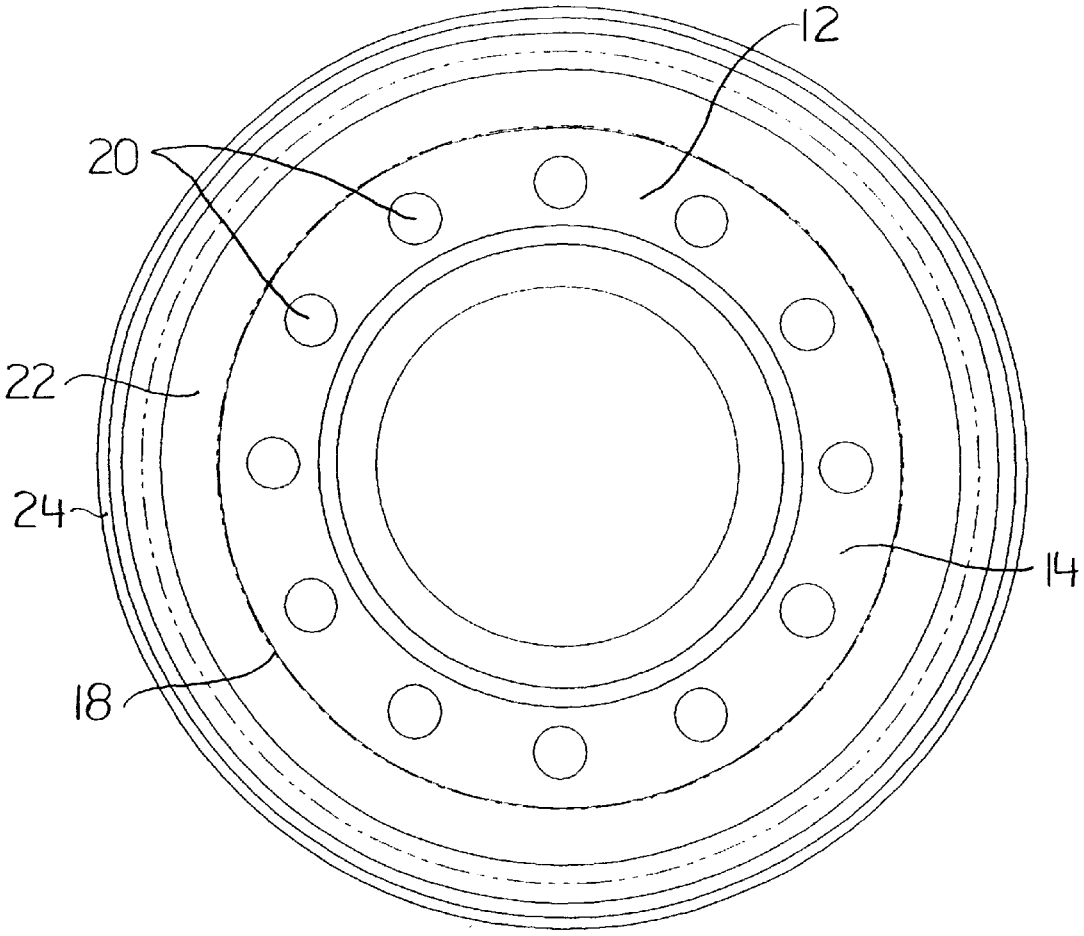
FIG. 2 is a top plan view of the annular ring illustrated in FIG. 1 with annular seal positioned thereon.
Figure 3:
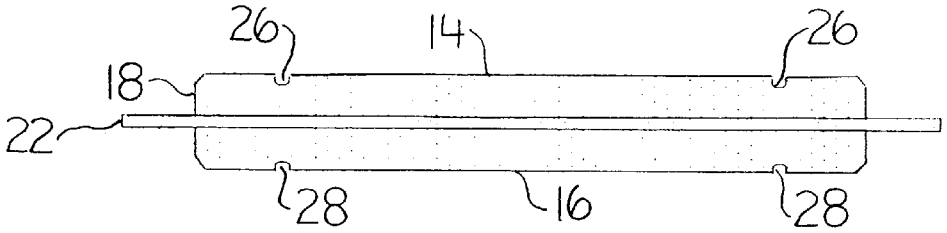
FIG. 3 is a section view of the annular ring illustrated in FIG. 1.
Figure 5:
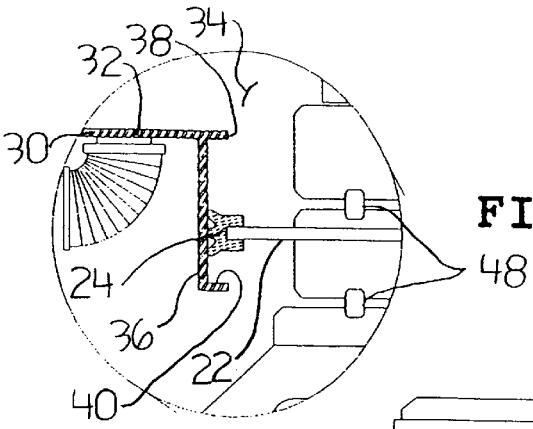
FIG. 5 is a detailed side elevation view of a portion of the apparatus illustrated in FIG. 4.
Figure 4:
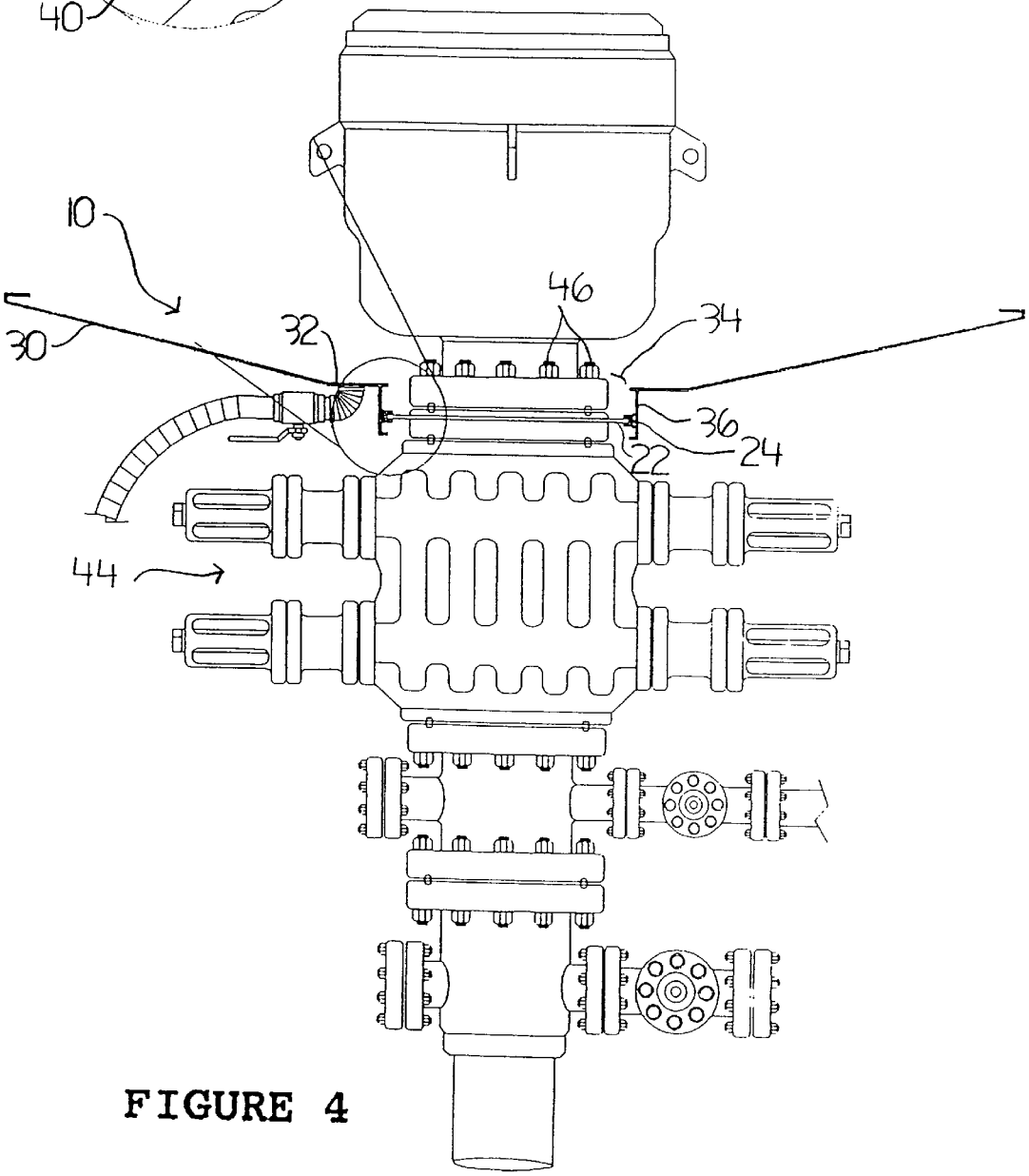
FIG. 4 is a side elevation view of an apparatus for preventing environmental contamination due to fluid leakage from a wellhead, secured on a wellhead.

Referring to FIG. 1, apparatus 10 includes an annular ring 12 having a top surface 14, a bottom surface 16, an outer edge 18 and a plurality of bolt receiving openings 20 extending between top surface 14 and bottom surface 16. Outer edge 18 is encircled by a flange 22. Referring to FIG. 2, an annular seal 24 encircles flange 22. Referring to FIG. 3, a seal ring groove 26 is positioned on top surface 14 and a seal ring groove 28 is position on bottom surface 16. Referring to FIG. 4, a catch pan 30 is provided having a drainage opening 32 and a central opening 34. Central opening 34 has a depending collar 36. Depending collar 36 is sized to fit snugly over flange 22. Referring to FIG. 5, annular seal 24 positioned on flange 22 engages depending collar 36 to prevent fluids leaking between flange 22 and catch pan 30. Stop means is provided in the form of two annular shoulders 38 and 40. Annular shoulder 38 and 40 project inwardly from depending collar 36 thereby providing a stop which limits movement of annular seal 24. Annular shoulder 38 is considered to be of greater importance than annular shoulder 40. In the absence of annular shoulder 38, if catch pan 30 became overloaded there is a possibility that the weight would result in catch pan 30 falling until flange 22 slid out of engagement with depending collar 36. This cannot happen for should catch pan 30 fall, annular shoulder 38 engages flange 22. A drain conduit 42 extends from drainage opening 32 in catch pan 30 to a storage container (not shown). The storage container can take any numbers of forms. Its purpose is merely to expand the capacity of catch pan 30.

The use and operation of apparatus 10 in accordance with the teachings of the preferred method will now be described with reference to FIGS. 1 through 5. In the description which follows a wellhead will be identified by reference numeral 44, and bolts by reference numeral 46 and annular seal rings by reference numeral 48 The method of use of the preferred form of apparatus 10, consists of the following steps. Firstly, providing an annular ring 12 as described above. Secondly, bolting annular ring 12 to wellhead 44 by means of bolts 46 extended through bolt receiving openings 20. In the process of bolting annular ring 12 to wellhead 44, annular seal rings 48 placed in seal ring grooves 26 and 28. Thirdly, a catch pan 30 is provided as described above. Fourthly, position depending collar 36 of catch pan 30 over flange 22 of annular ring 12, such that annular seal 24 snugly engages depending collar 36 to prevent leakage of fluids. Finally, secure drain conduit 42 so that it extends from drainage opening 32 in catch pan 30 to a storage container (not shown). With catch pan 30 in position, as described above, wellhead 44 is ready for servicing. To a greater or lesser degree, fluids will be invariably be released during servicing. Those fluids are caught by catch pan 30 from which they may be transferred to a larger storage container via drainage opening 32 and drain conduit 42.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A method for preventing environmental contamination due to fluid leakage from a wellhead, comprising the steps of:

providing an annular ring having a top surface, a bottom surface, an outer edge and a plurality of bolt receiving openings extending between the top surface and the bottom surface;

providing a catch pan having an interior surface defining a central opening;

providing an annular seal to securely support the interior surface of the catch pan on the outer edge of the annular ring in a fluid tight manner; and bolting the annular ring to the wellhead by positioning the annular ring between two wellhead components and securing the annular ring by means of bolts used to couple said two wellhead components extended through the bolt receiving openings.

2. The method as defined in claim 1, including the further step of securing a drain conduit from a drainage opening in the catch pan to a storage container.

3. A method for preventing environmental contamination due to fluid leakage from a wellhead, comprising the steps of:

providing an annular ring having a top surface, a bottom surface, an outer edge and a plurality of bolt receiving openings extending between the top surface and the bottom surface, the annular ring having a flange encircling the outer edge, the flange being encircled by an annular seal;

bolting the annular ring to the wellhead by positioning the annular ring between two wellhead components and securing the annular ring by means of bolts used to couple said two wellhead components extended through the bolt receiving openings;

providing a catch pan having a central opening with a depending collar, the depending collar being sized to fit snugly over the annular seal on the flange on the outer edge of the annular ring; and positioning the depending collar of the catch pan over the outer edge of the annular ring, such that the annular seal securely supports the depending collar on the flange in a fluid tight manner.

4. An apparatus for preventing environmental contamination due to fluid leakage from a wellhead, comprising:

a substantially planar body comprising an annular ring having a top surface, a bottom surface, an outer edge and a plurality of bolt receiving openings extending between the top surface and the bottom surface, the outer edge being encircled by a flange;

a catch pan having a collar defining a central opening sized to fit snugly over the flange, the catch pan being removably attached to the flange and supported by a fluid tight seal between the collar of the catch pan and the flange.

5. The apparatus as defined in claim 4, wherein the central opening has a depending collar, and the central opening has a depending collar, and the means for removably securing in a fluid tight manner the collar of the catch pan to the flange includes an annular seal encircling the flange, the annular seal engaging the depending collar to prevent fluids leaking between the flange and the catch pan.

6. The apparatus as defined in claim 5, wherein stop means project inwardly from the depending collar thereby providing a stop which limits movement of the annular seal.

7. The apparatus as defined in claim 4, wherein a seal ring groove is positioned on the top surface and the bottom surface of the annular ring.

8. The apparatus as defined in claim 4, wherein the catch pan has a drainage opening, a drain conduit extending from the drainage opening in the catch pan to a storage container.

9. An apparatus for preventing environmental contamination due to fluid leakage form a wellhead, comprising:

a substantially planar body comprising an annular ring having a top surface, a bottom surface, an outer edge and a plurality of bolt receiving openings extending between the top surface and the bottom surface, a seal ring groove is positioned on the top surface and the bottom surface of the annular ring, the outer edge being encircled by a flange, an annular seal encircling the flange;

a catch pan having a drainage opening and a central opening with a depending collar sized to fit snugly over the flange, the annular seal securing the depending collar to the flange to prevent fluids leaking between the flange and the catch pan;

stop means projecting inwardly from the depending collar thereby providing a stop which limits movement of the annular seal; and a drain conduit extending from the drainage opening in the catch pan to a storage container.

10. A fluid containment apparatus for preventing environmental contamination by fluid leaking from a well head, the fluid containment apparatus comprising:

a substantially planar annular flange having an outer engagement rim circumscribing a well head engagement portion, the engagement portion defining a plurality of bolt holes encircling a fluid passage wherein the annular flange is inserted between an existing joint in the well head without substantially increasing the height of the well head;

an oil catch pan having an inner engagement perimeter defining a central aperture, the inner perimeter being substantially the same circumference as the outer engagement rim of the annular flange; and an annular seal circumferentially sandwiched in between and securing the inner engagement perimeter of the oil catch pan to the outer engagement rim of the annular flange, wherein the annular seal securely supports the oil catch pan via a frictional, fluid-tight connection between the oil catch pan and the annular flange.

* * * * *